United States Patent [19]

Hughes

[11] 4,045,983

[45] Sept. 6, 1977

[54] UNIVERSAL BARREL KEY APPARATUS

[76] Inventor: Donald R. Hughes, 2600 Brower Ave., Simi Valley, Calif. 93065

[21] Appl. No.: 709,583

[22] Filed: July 29, 1976

[51] Int. Cl.[2] ..... E05B 19/02

[52] U.S. Cl. ..... 70/404; 70/411

[58] Field of Search ..... 70/411, 409, 404, 403, 70/402, 395

[56] References Cited

U.S. PATENT DOCUMENTS

| | | | |
|---|---|---|---|
| 3,142,167 | 7/1964 | Christopher | 70/411 |
| 3,330,141 | 7/1967 | Greenwald | 70/411 |
| 3,681,957 | 8/1972 | Sturgeon | 70/411 |
| 3,727,440 | 4/1973 | Greenwald | 70/411 |

*Primary Examiner*—Robert L. Wolfe
*Attorney, Agent, or Firm*—Jack C. Munro

[57] ABSTRACT

A barrel key apparatus wherein there is a handle section attached to a cylindrically shaped tubular section, within the cylindrically shaped tubular section there is located a plurality of spaced apart elongated grooves which are of the same length and extend from the outer free end of the tubular section. Within each of the grooves there may be selectively located one of a group of different length push pins. At the inner end of each groove is located an opening extending to the interior of the tubular section. The push pin includes an attaching means comprising a plurality of spaced apart annular ridges successively connected together along a single longitudinal axis. The attaching means is to be inserted within the opening at the end of the groove with the under surface configuration of the push pin matingly cooperating within the groove and the outer surface of the push pin cooperating with the outer surface of the tubular section to form a flush, smoothly contoured surface. The attaching means is such that it prevents withdrawal of the push pin once it has been inserted without destroying or damaging the pin.

8 Claims, 7 Drawing Figures

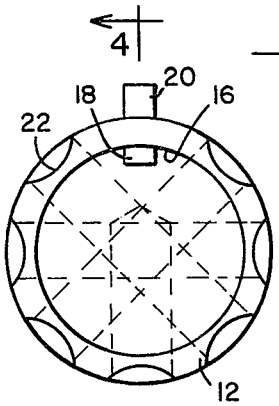
FIG.3
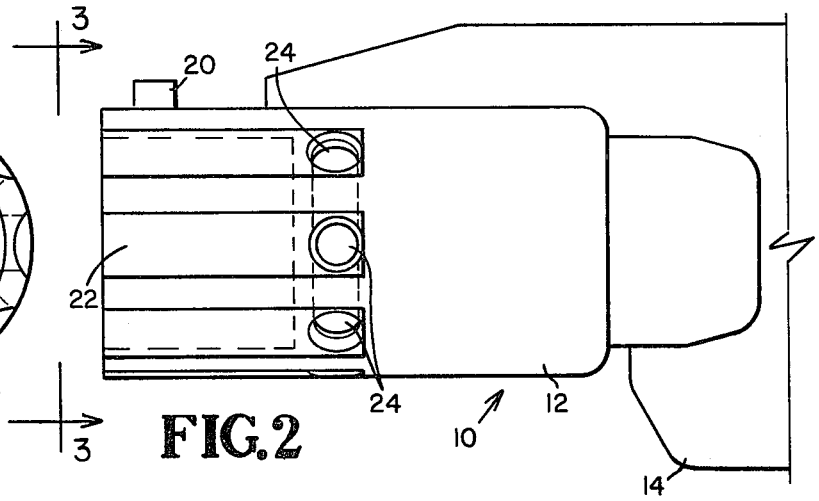
FIG.2
FIG.5
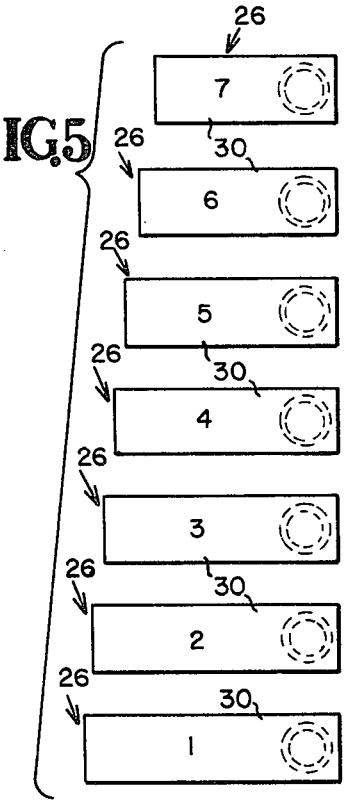
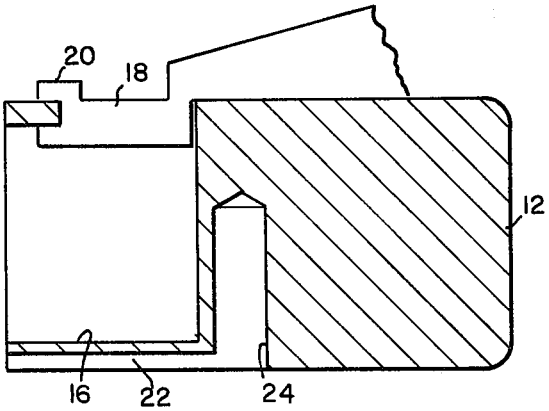
FIG.4
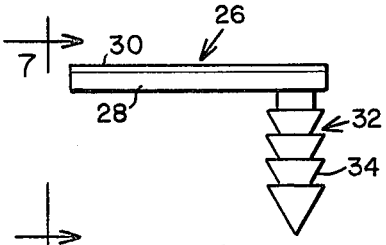
FIG.6
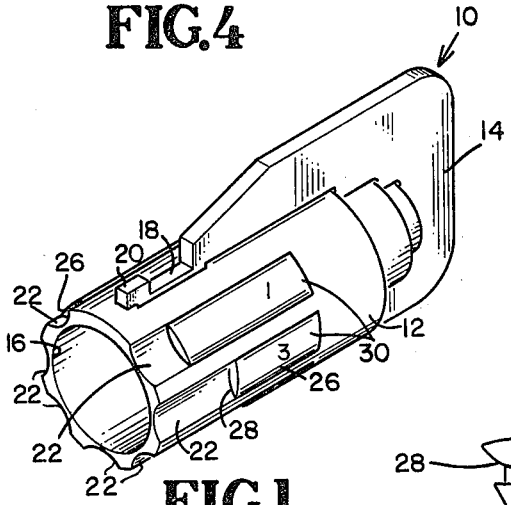
FIG.1
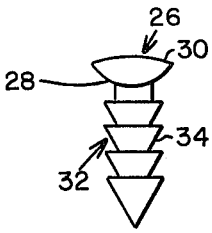
FIG.7

UNIVERSAL BARREL KEY APPARATUS

BACKGROUND OF THE INVENTION

The field of this invention relates to locks and more particularly to a multiple part key for operating cylindrical tubular type locks and the structure by which this type of key can be more easily and less expensively originated or duplicated.

In the installing and or services of locks, specifically the tubular or barrel type of lock, the locksmith establishes the particular "combination" for the lock and then installs and or services the lock within the desired location. The locksmith is required to have available a key cutting machine which is of substantial size and of substantial expense but can be transported normally by a small truck or van. Normally, this limited portability of the machine is necessary since the work effort of the locksmith is at various locations.

The locksmith then operates the machine to produce the desired lock combination within a key blank. This procedure is repeated for each lock and each key.

A primary disadvantage to the prior procedure is that the key cutting machines are quite expensive in cost and maintenance and are required to be driven by electrical power which may be supplied from the vehicle itself or from a portable electrical generator apparatus.

Such machines generally require a large initial expense and it is not uncommon for future locksmiths to be prevented from entering the locksmith profession because of the initial expense required. It is also not uncommon for existing locksmiths, already in the locksmithing profession, to be prevented from participating in this particular area/aspect of the profession because of high initial expense required.

Also, in the operating of any cutting machinery there is always a danger of injury from pieces of a broken cutter and metal chips from the key blank itself which are propelled through the air or due to electrical shock. Eliminating these dangers would inherently reduce the insurance premiums on persons who operate such machinery.

SUMMARY OF THE INVENTION

The key apparatus of this invention includes the use of a flat handle section which is connected to a tubular or cylindrical shaped tubular barrel. The handle has a vertical section adapted to be grasped by the hand and a longitudinally extended portion which fits within a notch located within the inner end of the tubular barrel and produces a longitudinally extending projection from the inner portion of the cylindrical shaped tubular barrel. This longitudinally extending portion is adapted to fit within a longitudinally extending groove in the plug of a tubular type of lock so as to guide the key into the proper location within the lock and also to lock the key and the plug against relative rotation when the key is inserted into the lock. The handle of the key apparatus and the barrel of said key apparatus are securely interlocked together. Upon the outer surface of the barrel are formed a plurality of longitudinally spaced apart, annularly located, elongated grooves. Each groove connects with the outer free end of the barrel. Within each groove and at the inner end thereof (nearest the handle) is located an opening. Each groove is adapted to receive one of a plurality of different lengths of push pins. Each of the push pins is to cooperate in a mating manner with each groove. The outer surface of each push pin is to be flush and form a continuous surface with the outer surface of the barrel. There will normally be seven different lengths of push pins but can be a fewer or greater amount. Connected to each push pin is an elongated member which is located perpendicular to the body of the push pin and is mounted at one end thereof. Upon the elongated members are located a plurality of spaced apart annular ridges. These ridges are formed so that such may be easily inserted within an opening formed within a said groove but are, for all practical purposes, impossible to remove without damage or destruction to the push pin and the entire key apparatus. Thus, the security of the coded key apparatus is maintained because said code cannot be altered, after assembly, by normal or surrepticious methods without destroying the push pins and the entire key apparatus.

The primary objective of the structure of this invention is that no cutting machine is required to construct an endless variety of keys, each having a different locking combination.

There are numercus secondary objectives, an example of which is the eliminating of the purchase of the cutting machine, no external electrical power required to operate said machine, no expense due to the operation and maintenance of said cutting machine, etc.

BRIEF DESCRIPTION OF THE DRAWING

FIG. 1 is a partial isometic view of the key structure of this invention showing in particular the barrel portion of the key;

FIG. 2 is a side view of the entire key of this invention;

FIG. 3 is an end view of the key structure of this invention taken along line 3—3 of FIG. 2;

FIG. 4 is a cross-sectional view taken along line 4—4 of FIG. 3;

FIG. 5 is an exploded top view of the different lengths of push pins which are to be available in constructing the key of this invention;

FIG. 6 is a side view of one of the push pins employed within this invention; and FIG. 7 is an end view of the push pins of FIG. 6 taken along line 7—7 of FIG. 6.

DETAILED DESCRIPTION OF THE SHOWN EMBODIMENT

Referring in particular to the drawings, there is shown a key 10 FIGS. 1 and 2, being divided into a tubular, cylindrical shaped barrel 12, FIGS. 1, 2 and 4, and a handle section 14, FIG. 2. The barrel 12 has an interior chamber 16, FIGS. 1, 3 and 4, which is opened at the outer end of the barrel 12. Surrounding the chamber 16, the barrel forms a thin ring. The ring is adapted to fit within a locking mechanism (not shown) which said locking mechanism includes a central protuberance therein which fits within the chamber 16. Upon this central protuberance (not shown) there is a longitudinal groove. In order to position the key correctly within the lock each time the key is inserted, the longitudinal groove of the protuberance matingly cooperates with a ridge 18. The ridge 18 is also connected to a radial protuberance 20 which is to slidingly connect within another longitudinal groove formed within the locking mechanism (not shown). The protuberance 20 and the ridge 18 are integrally formed in connection with the longitudinally extended portion of the handle 14. The handle 14 is secured by conventional securing means to the inner end of the barrel 12.

Located about the exterior surface of the barrel 12 and connecting with the outer end of the barrel are a plurality of spaced apart longitudinal grooves 22. There are seven in number of the grooves 22, but it is considered to be within the scope of this invention that any number of grooves 22 may be employed, and grooves 22 can be located around the exterior surface of the barrel 12 evenly spaced apart except for the grooves located around the outer surface and adjacent to the protuberance 20, which grooves can be irregularly spaced.

Each of the grooves 22 are of the same length and are of a constant cross-section. The grooves 22 are evenly spaced apart except for the grooves located adjacent the protuberance 20.

Located within each groove 22 adjacent the inner end thereof is an opening 24. The openings 24 are merely drilled holes that extend all the way through one wall thickness of the barrel 12 and matingly accepts the attaching member 32 of the push pin 26. Each opening 24 is to connect with a push pin 26. Once the push pin 26 is assembled into position the push pin cannot be removed without damaging or destroying the entire barrel key assembly.

Referring particularly to FIGS. 5, 6 and 7, there is shown a plurality of push pins 26. Each of the push pins 26 are of a different length with the push pin numbered one being of the longest length and the push pin numbered seven being of the shortest length. Each of the push pins 26 are basically constructed identical to each other with the exception of the length of the body section of the push pin. It is to be noted that there are seven in number of push pins 26 shown, but it is considered to be within the scope of this invention to have a fewer number of, or a greater number of push pins.

Each of the push pins 26 have a lower arcuate surface 28 and an upper arcuate surface 30. The lower arcuate surface 28 is to matingly cooperate with the arcuate surface formed within each of the grooves 22. When the push pin 26 is so located within the groove 22, the upper arcuate surface 30 is formed in the segment of a circle and will cooperate in a flush manner with the outer surface of the barrel 12 and form a continuous arcuate surface therewith. By observing FIG. 7 of the drawing, it can be readily seen that the radius of the lower arcuate surface 28 is substantially less than the radius of the upper arcuate surface 30. It is to be noted that the lower surface 28 need not be arcuate but may be polygonal or in any other configuration as long as it mates with the surface formed within the groove 22.

Attached to the inner end of each of the push pins 26 is an attaching member 32. The attaching member 32 includes a plurality of spaced apart interconnected annular ridges 34. Each of the ridges 24 are flattened at the surface nearest the body of the push pin but are tapered in the outward direction. This arrangement facilitates insertion of the attaching member 34 within and opening 24. This insertion is accomplished quite snugly, and once the push pin 32 is inserted into the opening 24 it is practically impossible to remove the push pin 32 without damaging or completely destroying the push pin 32 or the barrel 12. The reason for this is that the push pins 32, when inserted within the barrel 12, establish a particular combination upon the barrel 12 and it is not desired to have this combination changed or altered. This non-removing aspect of the push pin 32 prevents this changing or altering of the combination and adds to the security of the locking mechanism.

In actual practice, the locksmith will determine the combination of each of the grooves in a sequential order around the barrel 12. In other words, if the locksmith determines that the first groove is a one, the second groove is a three and the third groove is a four, etc., the locksmith will then select the appropriately numbered push pin 26 which will produce the desired combination. After the push pin 26 is inserted into position, the amount of the groove 22, which remains from the open end portion of the barrel 12 up to the front portion of the inserted push pin 26 determines the depth and value of the coded groove. The shorter the length of the groove remaining after the push pin 26 is inserted in the groove 22, the lower the value of the coded number will be. The longer the length of the groove remaining, the greater the value of the coded groove In summary, when using the push pins 26 in combination with the blank key 10, it is possible for a locksmith to assemble an infinite number of like coded keys and an almost infinite number of unlike coded keys.

What is claimed is:

1. A barrel key apparatus comprising:

a handle section;

a tubular section with an inner end attached to said handle section and terminating in an outer end, said tubular section being partially hollow with an access opening within the outer end thereof connecting with said hollow, said tubular section having a longitudinal center axis;

a projection extending inwardly through one wall thickness of the outer hollow surface of said tubular section adapted for cooperation with a mating groove in a lock to establish the proper inserting position within the lock;

said tubular section having a plurality of elongated grooves located upon the outer surface of said tubular section, each said groove beginning at said outer end and extending a predetermined distance towards said inner end terminating in a back end, an attaching opening provided within each said groove adjacent said back end, each said attaching opening being radially disposed in respect to said longitudinal center axis;

a plurality of elongated push pins of various lengths, each said push pin having mounted on one end thereof an attaching member, each said push pin having a body section having an upper surface and a lower surface, said lower surface to matingly cooperate within a said groove, said upper surface to be flush with the said outer surface of said tubular section, each said attaching member having securing means thereon, a said attaching member to be located entirely within an attaching opening and to be secured to said tubular section by said securing means.

2. The apparatus as defined in claim 1 wherein:

said tubular section being substantially cylindrical.

3. The apparatus as defined in claim 2 wherein:

the longitudinal axis of said elongated grooves being parallel to said longitudinal center axis of said cylindrical tubular section.

4. The apparatus as defined in claim 3 wherein:

each of said elongated grooves being substantially identical in cross-section and equal in length.

5. The apparatus as defined in claim 4 wherein:

each of said grooves being of a constant cross-sectional configuration.

6. The apparatus as defined in claim 5 wherein:

the lower surface of each said push pin being arcuate and comprising a segment of a circle, said upper surface being arcuate and comprising a segment of a circle, the radius of the contour of said lower surface being substantially less than the radius of the contour of said upper surface.

7. A barrel key apparatus comprising:

a handle section;

a tubular section with an inner end attached to said handle section and terminating in an outer end, said tubular section being partially hollow with an access opening within the outer end thereof connecting with said hollow;

a projection extending inwardly through one wall thickness of the outer hollow surface of said tubular section adapted for cooperation with a mating groove in a lock to establish the proper inserting position within the lock;

said tubular section having a plurality of elongated grooves located upon the outer surface of said tubular section, each said groove beginning at said outer end and extending a predetermined distance towards said inner end terminating in a back end, an attaching opening provided within each said groove adjacent said back end;

a plurality of elongated push pins of various lengths, each said push pin having mounted on one end thereof an attaching member, each said push pin having a body section having an upper surface and a lower surface, said lower surface to matingly cooperate within a said groove, said upper surface to be flush with the said outer surface of said tubular section, each said attaching member having securing means thereon, said attaching member to extend within an attaching opening and to be secured to said tubular section by said securing means;

said tubular section being substantially cylindrical;

said cylindrical tubular section having a longitudinal center axis, the longitudinal axis of said elongated grooves being parallel to said longitudinal center axis of said cylindrical tubular section;

each of said elongated grooves being substantially identical in cross-section and equal in length;

each of said grooves being of a constant cross-sectional configuration;

the lower surface of each said push pin being arcuate and comprising a seqment of a circle, said upper surface being arcuate and comprising a segment of a circle, the radius of the contour of said lower surface being substantially less than the radius of the contour of said upper surface;

each said securing means comprises a plurality of spaced apart annular ridges.

8. A barrel key apparatus comprising;

a handle section;

a tubular section with an inner end attached to said handle section and terminating in an outer end, said tubular section being partially hollow with an access opening within the outer end thereof connecting with said hollow;

a projection extending inwardly through one wall thickness of the outer hollow surface of said tubular section adapted for cooperation with a mating groove in a lock to establish the proper inserting position within the lock;

said tubular section having a plurality of elongated grooves located upon the outer surface of said tubular section, each said groove beginning at said outer end and extending a predetermined distance towards said inner end terminating in a back end, an attaching opening provided within each said groove adjacent said back end;

a plurality of elongated push pins of various lengths, each said push pin having mounted on one end thereof an attaching member, each said push pin having a body section having an upper surface and a lower surface, said lower surface to matingly cooperate within a said groove, said upper surface to be flush with the said outer surface of said tubular section, each said attaching member having securing means thereon, said attaching member to extend within an attaching opening and to be secured to said tubular section by said securing means;

each said securing means comprises a plurality of spaced apart annular ridges.

* * * * *